US005381709A

United States Patent [19]

Louw

[11] Patent Number: 5,381,709

[45] Date of Patent: Jan. 17, 1995

[54] APPLICATION TOOL FOR TORQUE-CONTROLLED FASTENING SYSTEM

[76] Inventor: John A. Louw, 27930 Ridgebluff Ct., Rancho Palos Verdes, Calif. 90274

[21] Appl. No.: 75,791

[22] Filed: Jun. 14, 1993

[51] Int. Cl.[6] ..... B25B 13/06

[52] U.S. Cl. ..... 81/59.1; 81/176.2; 81/121.1

[58] Field of Search ..... 81/176.1, 176.15, 176.2, 81/176.3, 119, 120, 121.1, 186, 59.1; 279/9.1, 76, 22, 30

[56] References Cited

U.S. PATENT DOCUMENTS 4,817,475 4/1989 Kelly et al. ..... 81/121.1

4,881,316 11/1989 Wing ..... 29/510

*Primary Examiner*—D. S. Meislin

*Attorney, Agent, or Firm*—Plante & Strauss

[57] ABSTRACT

There is disclosed a driving tool for securing a fastener collar to a threaded pin in which the collar has a plurality of external, axial lobes at equally spaced angular increments. The driving tool has a driver socket with a collar receptacle which is open on at least one end and which fixedly receives a retainer sleeve which supports a plurality of driver balls that are fixedly and non-rotationally carried at spaced apart angular increments. The retainer sleeve is bored to form spherical recesses, each of which receives a driver ball. The inwardly directed faces of the balls protrude into the interior of the collar to form spherical lugs, and the opposite surfaces of the driver balls are ground or flatted to conform to the surrounding wall of the shell of the driving tool.

19 Claims, 4 Drawing Sheets

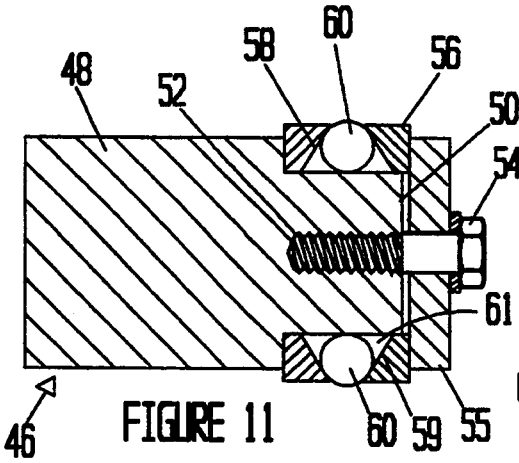
FIGURE 11
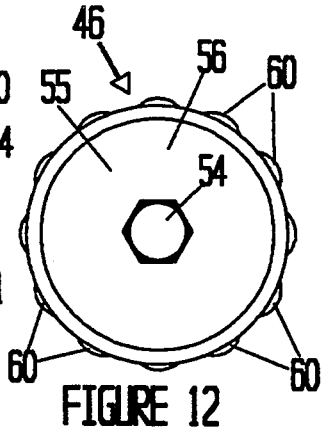
FIGURE 12
FIGURE 13
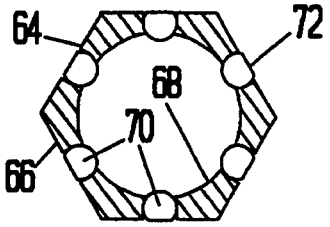
FIGURE 15
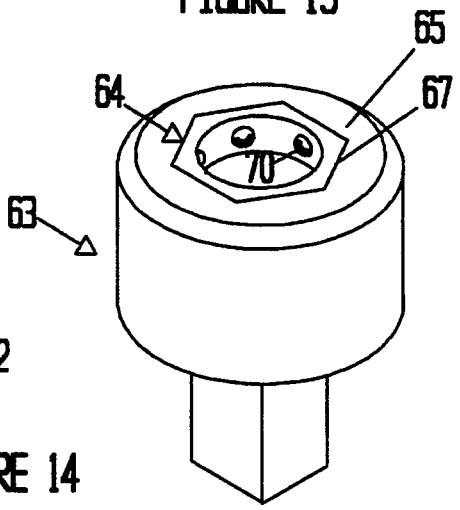
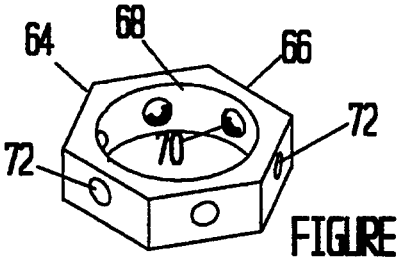
FIGURE 14
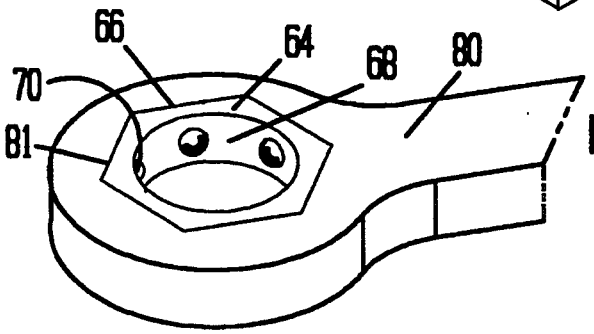
FIGURE 16

APPLICATION TOOL FOR TORQUE-CONTROLLED FASTENING SYSTEM

BACKGROUND OF INVENTION

1. Field of Invention

This invention relates to a fastener tool for the installation of fasteners in a torque-controlled fastening system and, in particular, to a wrench of improved design and construction for such system.

2. Brief Statement of the Prior Art

U.S. Pat. Nos. 4,881,316 and 5,012,704 to George S. Wing, describe a torque-controlled fastening system using a threaded torque collar and a ball driver for the collar. The inventions disclosed in these patents have been commercially adapted under the name NOVA-HEX fastening systems in which six axial lobes are located at equal angular increments on the external surface of the fastener collars. The collars are applied with a wrenching tool that has six rotating, driver balls which are captured in a sleeve retainer. The inwardly facing spherical faces of the driver balls are received in the grooves between the axial lobes of the collars. When the torque applied by the wrenching tool reaches the prescribed limiting torque for the collar and driver, the driver balls roll through the lobes, plowing the material to form a circumferential furrow. The value of the limiting torque depends on the diametric spacing between the faces of opposed balls, which is referred to as the critical diameter.

The aforementioned fastening system provides a number of desirable features such as ease of inspection, as the furrows readily indicate proper application of the fastener collars. Additionally, the torque history of the fastener can be observed by inspection since on reapplication of the fastening collar a wrench is used which has the driver balls at a different axial position, thereby forming a second circumferential furrow through the lobes of the collar. In this manner, up to three applications of a collar can be made, resulting in three axially disposed furrows and a permanent record of the number of installations of the collar.

The wrenching tool disclosed in the '704 patent is prepared by extruding, at extremely high pressure, a soft metal sleeve over the driver balls which are held at precise spacings during the extrusion. The extrusions must then be heat treated at temperatures of about 1725° F. to develop sufficient strength. Unfortunately, the heat treatment causes dimensional distortions, and a majority of the heat treated products must be discarded because of unacceptable variation in their critical diameter.

OBJECTIVES OF THE INVENTION

It is an objective of this invention to provide a wrenching tool for torque-controlled fastening systems.

It is an additional objective of this invention to provide a wrenching tool which is less costly to manufacture than the prior installation tools for torque-controlled fastening systems.

It is a further objective of this invention to provide an application tool for torque-controlled fastening systems which provides a highly consistent installation torque.

It is likewise an objective of this invention to provide an installation tool for the application of collars torque-controlled fastening systems which provides a wide choice of materials for the tool.

It is also an objective of this invention to provide an application tool having reduced dimensions from the application tools previously used for the installation of torque-controlled fastening systems.

Other and related objectives will be apparent from the following description of the invention.

BRIEF DESCRIPTION OF THE INVENTION

The invention comprises a driving tool for securing a fastener collar to a threaded pin in which the collar has a plurality of external, axial lobes at equally spaced angular increments. The driving tool has a socket with a collar receptacle which is open on at least one end and which fixedly receives a retainer sleeve that supports a plurality of driver balls that are fixedly and non-rotationally carried at spaced apart angular increments. The retainer sleeve is bored to form ball recesses, each of which receives a driver ball. The ball recesses are cylindrical bores with hemispherical bottom walls that are open to permit the inwardly directed faces of the balls to protrude into the interior of the collar, forming spherical lugs. The opposite surfaces of the driver balls have surfaces which conform to the surrounding wall of the shell of the driving tool.

BRIEF DESCRIPTION OF THE FIGURES

The invention will be described with reference to the FIGURES of which:

FIGS. 11 and 12 illustrate a fixture for forming the driver balls used in the driver retainer ring of the invention; and FIGS. 13–15 illustrate an alternative driver retainer ring and wrenching tool of the invention.

FIG. 16 illustrates the driver ring of FIGS. 13 and 14 in a box wrench.

DESCRIPTION OF PREFERRED EMBODIMENT

Figure 1:
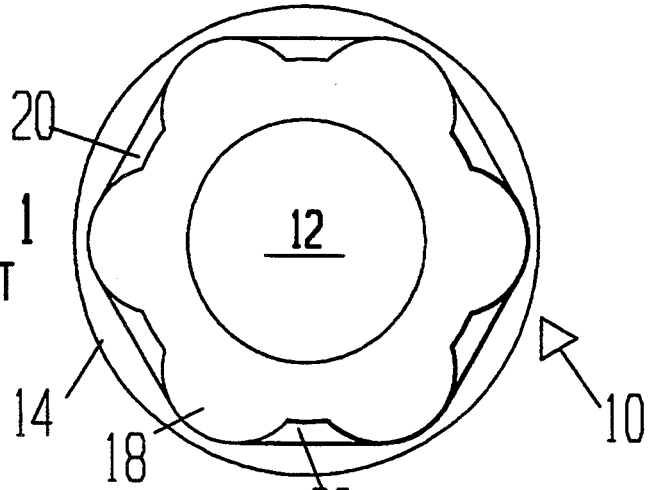
FIGURE 1 PRIOR ART
FIGS. 1–3 illustrate a collar used in the prior art torque-controlled fastening system.
Figure 2:
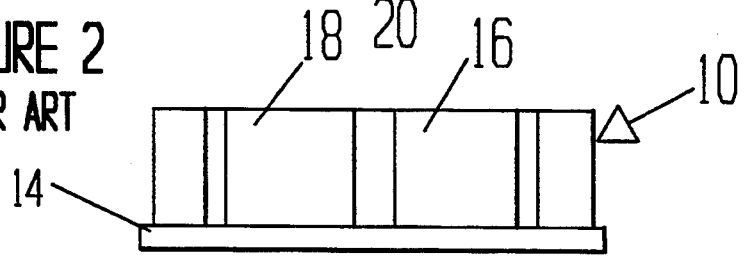
FIGURE 2 PRIOR ART
Figure 3:
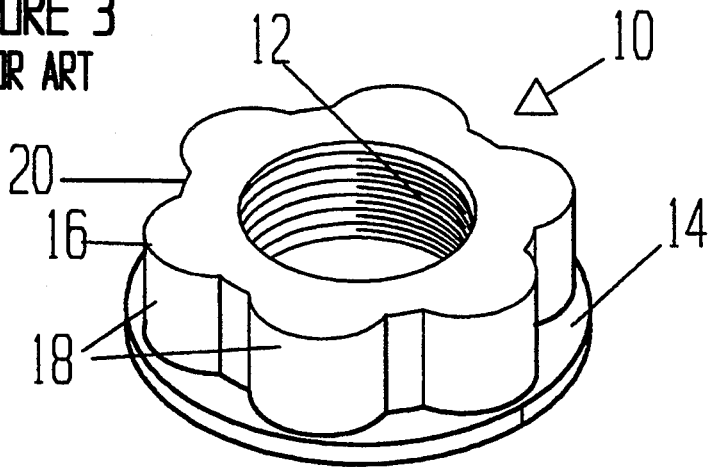
FIGURE 3 PRIOR ART

Referring now to FIGS. 1–3, there is illustrated a collar 10 of the NOVA-HEX torque-controlled fastening systems used in the prior art. The collar 10 has a central, threaded through aperture 12 and in the illustrated embodiment, has a base flange 14. The external surface 16 of the collar 10 has six axial lobes 18 which are spaced apart at equal angular increments, forming interspaced axial grooves 20. This collar 10 can be applied and removed using conventional wrenches and sockets, e.g., hexagonally flatted sockets and wrenches for conventional fasteners. The collar, however, is intended to be applied with a wrenching tool having a plurality of balls that are secured by a sleeve retainer and which are applied over the collar 10 with the balls seating in the axial grooves 20. When the prescribed torque level of the fastener is reached, these balls plow through the axial lobes 18 forming a circumferential furrow in the lobes. The prescribed torque level is critically dependent on the precise diametric spacing (critical diameter) between the inward faces of the driver balls.

Figure 4:
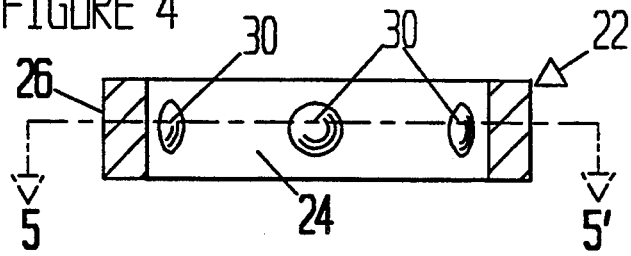
FIG. 4 is a cross-sectional view along an axial plane through a retainer ring of the invention for applying the collar shown in FIGS. 1–3.
Figure 5:
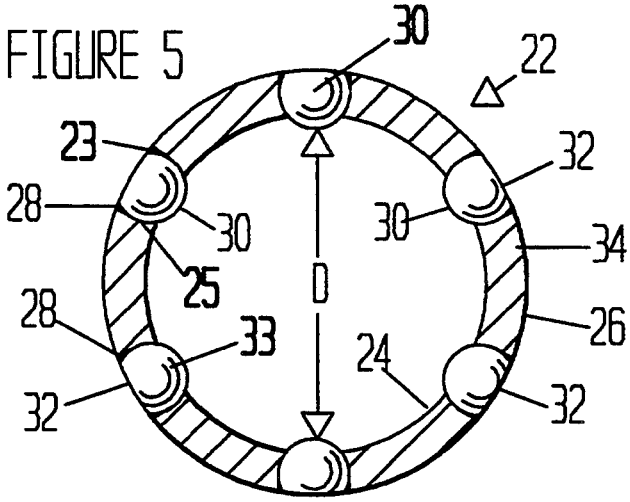
FIG. 5 is a cross-sectional view along lines 5—5' of FIG. 4.
Figure 6:
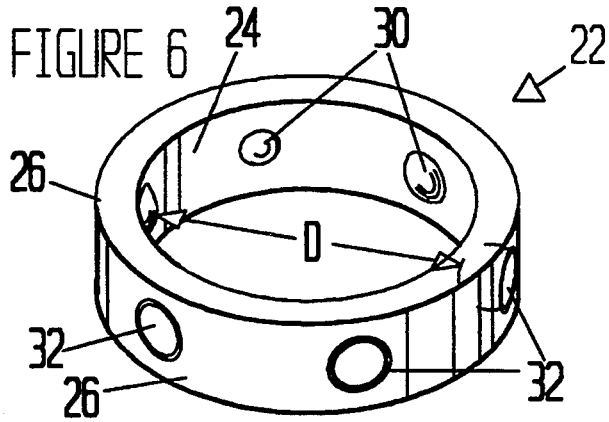
FIG. 6 is a perspective view of the retainer ring of the invention.
Figure 7:
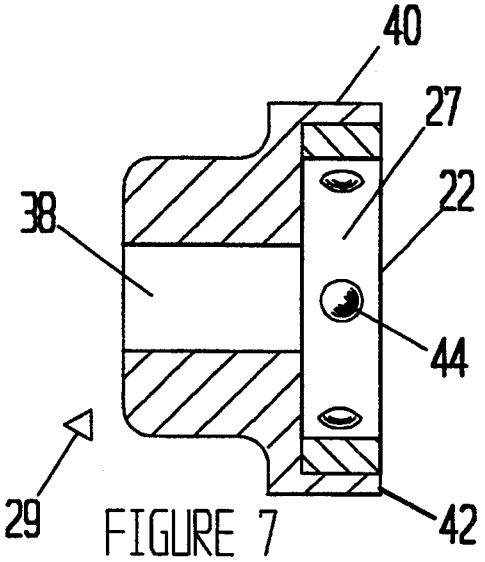
FIGS. 7–10 illustrate a driving tool socket fitted with the driver retainer ring of the invention.

The driver retainer ring 22 of the invention is illustrated in FIGS. 4–6. The driver retainer ring 22 has an internal right cylindrical surface 24 and, in its preferred and illustrated embodiment is a cylindrical ring with an outer right cylindrical surface 26. The interior of the ring is the collar recess for the driving tool in which the retainer ring is used.

The ring 22 has a plurality of ball recesses 28. These recesses have a short cylindrical portion 23 adjacent the outer surface 26 and a hemispherical section 25 which intersects the inner surface 24, forming six, equally spaced apart through apertures in the side wall of the ring 22. A plurality of driver balls 30 are seated, one each in each ball recess 28, with inwardly directed spherical faces 33 projecting into the collar recess which define the spherical lugs for the driving tool of the invention. The outer faces 32 of the driver balls are cylindrical and generally coincide with the outer cylindrical surface 26 of the driver ring 22.

The driver ring 22 is formed from strong but machinable steel or from powdered metal or cast material and can be heat treated as necessary without losing its critical dimensions, such as diameter D which is the minimum diameter between opposed driver balls 30. The driver balls 30 are formed of a suitable hard and wear resistant commercial material such as tungsten carbide, hardened stainless steel, ceramic, etc.

The driver ring 22 is drilled with equally angularly spaced holes on radial center lines which have a diameter from 70 to 80 percent of the diameter of the driver balls 30. The resulting bores are then milled with a spherical end mill having a diameter approximately equal to the diameter of the driver balls 30 until the apex of the mill reaches the critical diameter D (see FIG. 5).

Hard surfaced, wear resistant balls 30 are seated in the recesses 28 until their inwardly directed spherical faces 33 reach the critical diameter D. For this purpose, the sleeve or ring can be positioned on a centering mandrel having an external diameter equal to the critical diameter D, thereby achieving accurate penetration of the driver balls 30 into the collar recess 27 of the retainer ring 22. The outer faces 32 of the balls are machined to form outer cylindrical surfaces which are generally coincident with the outer cylindrical surface 26 of the ring 22. Preferably, the outer faces 32 are formed to within 0.001 to 0.002 inch of the outer diameter of the ring 22 thereby providing cylindrical faces 32 which protrude slightly beyond the outer surface 26 of the ring 22. Various machining operations can be practiced to form the cylindrical faces 32 such as grinding or electronic discharge machining (EDM), particularly wire EDM cutting. This provides a thin annulus between the outer surface 26 of the retainer ring 22 and the surrounding shell of the driving tool to accept adhesives, brazing and the like, as described hereinafter. The balls can be machined to form a cylindrical face on each ball prior to assembly in the retainer ring, or can be machined after assembly.

The slight projection of the cylindrical outer faces 32 of the balls also permits precise control of the critical diameter by precise control of the cylindrical outer face and the internal diameter of the recess of the wrenching tool which receives the retainer ring and driver balls, as described hereinafter with regard to FIGS. 7–10.

Referring now to FIGS. 7–10, there is illustrated a wrenching tool 29 which incorporates the driver ring 22 of the invention. As illustrated, the wrenching tool 29 is a tool socket having a conventional external shape and dimensions with an end socket 38 that has internal flats, preferably square in cross section, as illustrated, for attachment to conventional driver tools such as a ratcheting wrench, air powered rotational driving tool, etc. The tool 29 has a driver section 40 with a generally cylindrical shell 42. The retainer ring 22 shown in FIGS. 4–6 is received in the cylindrical socket shell 42 and is permanently affixed therein by a suitable method such as chemical bonding with adhesives, e.g., the anaerobic adhesives commercially available under the LOCKTITE designation which are dimethacrylate adhesive resins and organic peroxide catalysts, which have cure rates that reach fixture in 10 minutes and full cures in 72 hours. Alternatively, other adhesives can be used, e.g., epoxy resins and hardener mixtures, etc. Alternatively, the retaining ring and driver balls can be locked in the driving tool by brazing, welding and the like.

Figure 8:
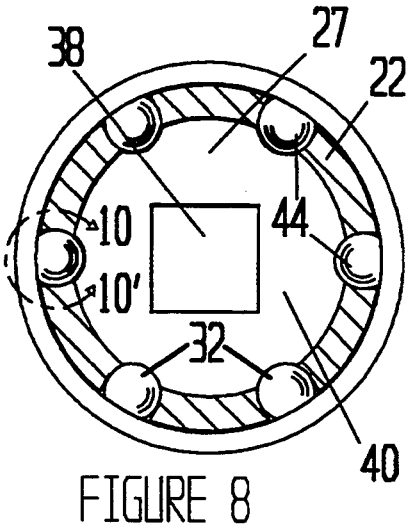
Figure 9:
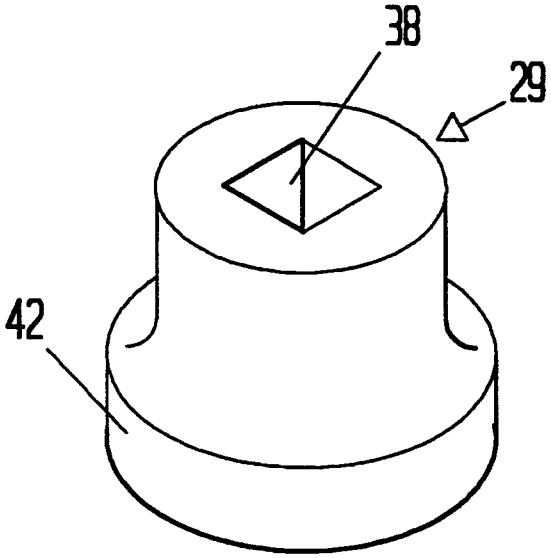
Figure 10:
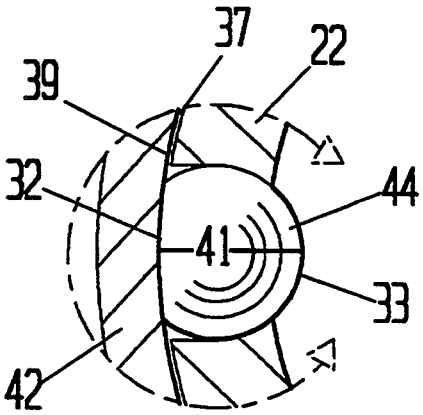

FIG. 10 is an enlarged view of the area within line 10—10' of FIG. 8, and illustrates that the shell 42 has an internal diameter that is slightly greater, e.g., from 0.001 to 0.003 inch greater, than the external diameter of the ring 22 thereby forming a thin annulus 37 in which is received adhesive, brazing, etc. The cylindrical face 32 of ball 44 projects into the annulus 37 and bears against the internal wall 39 of the shell 42. As previously mentioned, this provides a simple procedure to control the critical diameter D (see FIG. 5) by controlling the internal diameter of the shell 42 and the thickness 41 of the ball between its cylindrical face 32 and its spherical face 33.

A tool 46 for grinding or cutting the cylindrical outer faces 32 on the driver balls 30 prior to their assembly in the retainer ring 22 is shown in FIGS. 11 and 12. FIG. 11 is an elevational sectional view through the tool 46. The tool 46 comprises a mandrel 48 having an end 50 of the critical diameter D, and has an axial, threaded tap that receives a conventional mechanical fastener such as screw 54, which secures retainer plate 55 against sleeves 56 and 58. Sleeves 56 and 58 are received over the end 50 of the mandrel 48. Each sleeve has a tapered inside wall 59 and the sleeves are assembled with the tapered walls 59 opposed, forming a V-slot 61 which receives driver balls 60. The balls 60 are placed in the slot 61 in a tight array, with the outer surface of each driver ball 60 protruding beyond the outer cylindrical surface 62 of the sleeves 56 and 57 the required distance to allow the desired amount of material to be removed from the driver balls 60 in a machining step. FIG. 12 illustrates an end view of the tool 46 showing a plurality of driver balls 60 which are mounted, ready for machining to form cylindrical outer faces.

The preferred embodiment shown in FIGS. 4–10 employs a right cylindrical retainer ring for the driver. This relies on adhesive bonding, welding or brazing for transmitting the application torque from the wrenching tool to the driver balls.

Alternative shapes or configurations can be used, and FIGS. 13–15 illustrate an alternative wrenching tool 63 which receives a driver retainer ring 64 that has a hexagonal external surface 66, and a right cylindrical inside surface 68. In this application the outer faces 72 of the driver balls 70 are planar and coincident with the outer flatted surfaces 66 of the hexagonal retainer ring 64. This retainer ring is received in the hexagonally walled socket 65, and is permanently secured therein by bonding with adhesives, welding or brazing, or by press fitting. As with the previously described tool 36 of FIGS. 7–10, the critical diameter D can be controlled by the distance between the opposed flatted surfaces 67 of the wrenching tool 63 and the thickness of the balls 70; see FIG. 15.

FIG. 16 illustrates one end of a box wrench 80 which also receives the driver retainer ring 64 (see FIGS. 13 and which has a hexagonal external surface 66, and a right cylindrical inside surface 68. In this application the outer faces 72 of the driver balls 70 are coincident with the outer flatted surfaces 66 of the hexagonal aperture 81 of the box wrench 80. As with the embodiment shown in FIG. 15, the retainer ring is permanently secured within the hexagonal aperture 81 by bonding with adhesives, welding or brazing, or by press fitting.

The invention provides significant advantages over the prior art driver tools. The driver of this invention can be manufactured considerably more economically than the tools described in the '704 patent. The driving elements do not weaken the housing and, accordingly, a smaller dimension housing can be used. The radial placement of the driver balls is very precise and, since heat treatment after assembly is avoided, there is no possibility of distortion of the location or orientation of the driver balls by heat treatment. Additionally, there is an advantage to the non-rotation of the driver balls as it has been observed that variations occur in the prescribed torque level when applying the fasteners with tools having driver balls designed to rotate, but which frequently fail to rotate in practice.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A driver for securing a fastener collar to a threaded pin, which collar has a plurality of external, axial lobes at equally spaced angular increments, which comprises an assembly of:

a. a driver socket having a shell with a collar receptacle open on at least one end and having an internal sidewall;

b. a ring member fixedly received within said shell and surrounding said receptacle;

c. a like plurality of spherically-faced driver elements carried in said ring at spaced-apart increments substantially equal to said spaced increments with their spherical faces projecting into said receptacle, each of said driver elements also having a non-spherical face that fixedly and non-rotationally secures said driver elements in said assembly; and c. means to impart a rotational force to said driver socket.

2. The driver of claim 1 wherein said ring member has a plurality of recesses at equal spaced-apart angular increments in which said spherically-faced driver elements are fixedly received, one each in each of said recesses.

3. The driver of claim 2 wherein said ring member is cylindrical and has an outer cylindrical surface.

4. The driver of claim 3 wherein said driver elements protrude through said recesses into said receptacle.

5. The driver of claim 4 wherein the outer surfaces of said driver elements conform to the outer cylindrical surface of said ring member.

6. The driver of claim 5 wherein the shell of said driver socket has a cylindrical cavity which receives said ring member.

7. The driver of claim 1 wherein said ring member is fixedly secured in said shell by adhesive bonding.

8. The driver of claim 1 wherein said ring member is welded within said shell.

9. The driver of claim 1 wherein said shell is generally cylindrical and said means to apply a rotational torque thereto comprises a shank having a non-circular cross section extending from one end thereof.

10. A driver for securing a fastener collar to a threaded pin, which collar has a plurality of external, axial lobes at equally spaced angular increments, which comprises an assembly of:

a. a driver socket having a shell with a collar receptacle open on at least one end and having an internal sidewall having flats;

b. a ring member fixedly received within said shell;

c. a like plurality of spherically-faced driver elements carried in said ring at spaced-apart increments substantially equal to said spaced increments, said driver elements having planar outer surfaces to conform to said flats; and c. means to impart a rotational force to said driver socket.

11. An assembly of driver elements and retainer ring for fixed mounting in a rotational drive tool to permit its use to secure threaded collars having axial lobes at equal angular increments on its external surface onto threaded pins, which comprises:

a. a retainer ring having an annular wall surrounding a central cavity and having a plurality of radial recesses extending through said annular wall and located at spaced-apart angular increments corresponding to said equal angular increments;

b. a like plurality of driver elements, one each, fixedly secured within each of said radial recesses and having radially inward faces protruding into said central cavity and radially outward faces coincident with the external wall of said ring.

12. The assembly of claim 11 wherein said ring is a right cylindrical ring.

13. The assembly of claim 12 wherein said driver elements are formed of material having a greater hardness than the material of said ring.

14. The assembly of claim 13 wherein said driver elements are formed of a metal carbide.

15. The assembly of claim 14 wherein said driver elements are formed of a tungsten carbide.

16. The combination of the assembly of claim 11 and a rotational driving member having a shell with a receptacle open on at least one end, which fixedly receives said assembly therein.

17. The combination of claim 16 wherein said driving member is a box wrench.

18. The combination of claim 16 wherein said driving member is a socket member.

19. The driver of claim 1 wherein said shell has flats on its inner wall, and said driver elements have planar outer surfaces to conform to said flats.

* * * * *